US009414735B2

(12) United States Patent
Howard et al.

(10) Patent No.: US 9,414,735 B2
(45) Date of Patent: Aug. 16, 2016

(54) MOP BUCKET

(71) Applicant: VALE MILL (ROCHDALE) LIMITED, Rochdale (GB)

(72) Inventors: Michael Howard, Rochdale (GB); Darren Brian Trowsdale, Leeds (GB)

(73) Assignee: VALE MILL (ROCHDALE) LIMITED, Rochdale (GB)

( * ) Notice: Subject to any disclaimer, the term of this patent is extended or adjusted under 35 U.S.C. 154(b) by 0 days.

(21) Appl. No.: 14/201,956

(22) Filed: Mar. 10, 2014

(65) Prior Publication Data

US 2014/0250624 A1 Sep. 11, 2014

(51) Int. Cl.
*A47L 13/58* (2006.01)
*A47L 13/51* (2006.01)

(52) U.S. Cl.
CPC *A47L 13/58* (2013.01); *A47L 13/51* (2013.01)

(58) Field of Classification Search
CPC ..... A47L 13/58; A47J 47/18
USPC ..... 15/260, 264; 206/515–516
See application file for complete search history.

(56) References Cited

U.S. PATENT DOCUMENTS

| | | | | | |
|---|---|---|---|---|---|
| 3,341,876 | A * | 9/1967 | Campbell | ..... | 15/1 |
| 2010/0223749 | A1 | 9/2010 | Chiang | | |
| 2011/0173770 | A1* | 7/2011 | Chen | ..... | 15/260 |
| 2013/0092698 | A1* | 4/2013 | Orlandi | ..... | 220/660 |

FOREIGN PATENT DOCUMENTS

| | | | | | |
|---|---|---|---|---|---|
| AU | 2010101343 | B4 | | 1/2011 | |
| CN | 2533800 | Y | | 2/2003 | |
| DE | 202 20 311 | U1 | | 5/2003 | |
| EP | 0910983 | | * | 4/1999 | ..... A47L 13/58 |
| FR | 2405692 | A1 | | 5/1979 | |
| GB | 2 284 979 | A | | 6/1995 | |
| GB | 2 304 543 | A | | 3/1997 | |
| WO | 2011/150647 | A1 | | 12/2011 | |

OTHER PUBLICATIONS

British Search Report, dated Jul. 10, 2013, from corresponding British application.
British Examination Report, dated Apr. 21, 2016, from corresponding GB application.

* cited by examiner

*Primary Examiner* — Laura C Guidotti
(74) *Attorney, Agent, or Firm* — Young & Thompson

(57) ABSTRACT

A mop bucket (100) having a side (104) and a detachable wringer (112). Part of the side extends into the bucket to form a support (108) for the detachable wringer (112). The side may be the base (102) of the bucket. The wringer support (108) may have a cavity (111) that is accessible from the side and which is shaped to receive a corresponding support on a corresponding bucket.

20 Claims, 11 Drawing Sheets

100

MOP BUCKET

TECHNICAL FIELD OF THE INVENTION

The present invention relates to a mop bucket.

BACKGROUND TO THE INVENTION

Mop buckets are generally used in combination with mops to clean surfaces. A mop bucket typically comprises a basin in which water and other cleaning solutions may be contained and a wringer which is shaped and configured to receive a mop head and enable it to be squeezed to drain water from the mop head back into the basin. The wringer usually comprises a concave shaped body having a number of apertures. The cloth or fabric cleaning elements of the mop head may be placed in the body and urged against the body walls to squeeze the mop head and urge water out from the cleaning elements.

A problem with conventional mop buckets is that the wringer usually extends deep into the basin of the bucket and this limits the level to which liquid in the bucket may be filled. Thus, the volume of liquid that a conventional mop bucket may hold is restricted. In addition, the wringer makes stacking conventional mop buckets difficult and this is particularly disadvantageous where space is at a premium, for example on supermarket shelves or when being transported.

It is an object of the present invention to overcome at least some of these difficulties.

SUMMARY OF THE INVENTION

According to the present invention, there is provided a mop bucket comprising a side and a detachable wringer, wherein a part of the side extends into the bucket to form a support for the detachable wringer.

Advantageously, the support may be arranged to support a wringer from a position close to an open part of the bucket, thereby increasing the level to which liquid in the bucket may be filled and thereby increasing the effective bucket capacity.

The side may comprise the base. The bucket may further comprise a sidewall.

The wringer support may comprise a cavity that is accessible from an outer face of the side of the bucket and which is shaped to receive a corresponding support on a corresponding bucket.

Advantageously, the cavity permits a plurality of buckets according to the invention to be stacked in a close interlocking relationship thereby saving on storage and transportation space.

Part of the wringer may be shaped such that, in one orientation, the part conforms to at least part of the external shape of the support. Part of the wringer may be shaped such that, in one orientation, the part envelopes at least part of the support. Part of the wringer may be shaped such that, in one orientation, the part conforms to the shape of the cavity.

The wringer may be arranged between part of the support of one bucket and part of the support of another bucket and may be shaped to conform to both parts. The bucket may be arranged to nest with other corresponding buckets.

The bucket may further comprise a lip that extends into the bucket from a side and the wringer may comprise one or more supporting arms that are arranged such that when the wringer is seated on the wringer support, an end of the or each arm abuts the lip to stabilise the wringer when seated on the support.

The wringer and the support may comprise mutually cooperating attachment means that enable the wringer to be attached to the support. The attachment means on the support may be clips and the attachment means on the wringer may be apertures for receiving the clips.

The bucket may further comprise a handle which is attached to two points of a side, the handle being arranged such that, when the bucket is supported via the handle, the centre of gravity of the bucket is substantially between the two points.

The bucket may further comprise one or more ribs formed on the outside of a side and arranged to abut part of an adjacent bucket when two or more buckets are stacked together.

Advantageously, the size and shape of the ribs can be chosen to control the distance of separation between two stacked adjacent buckets.

Part of the support and part of the wringer may be substantially the same shape. The support may extend into the bucket to a position at which the wringer may be supported such that the wringer extends substantially out from the bucket.

DETAILED DESCRIPTION OF THE INVENTION

In order that the invention may be more clearly understood embodiments thereof will now be described, by way of example only, with reference to the accompanying drawings, of which:

Figure 1:
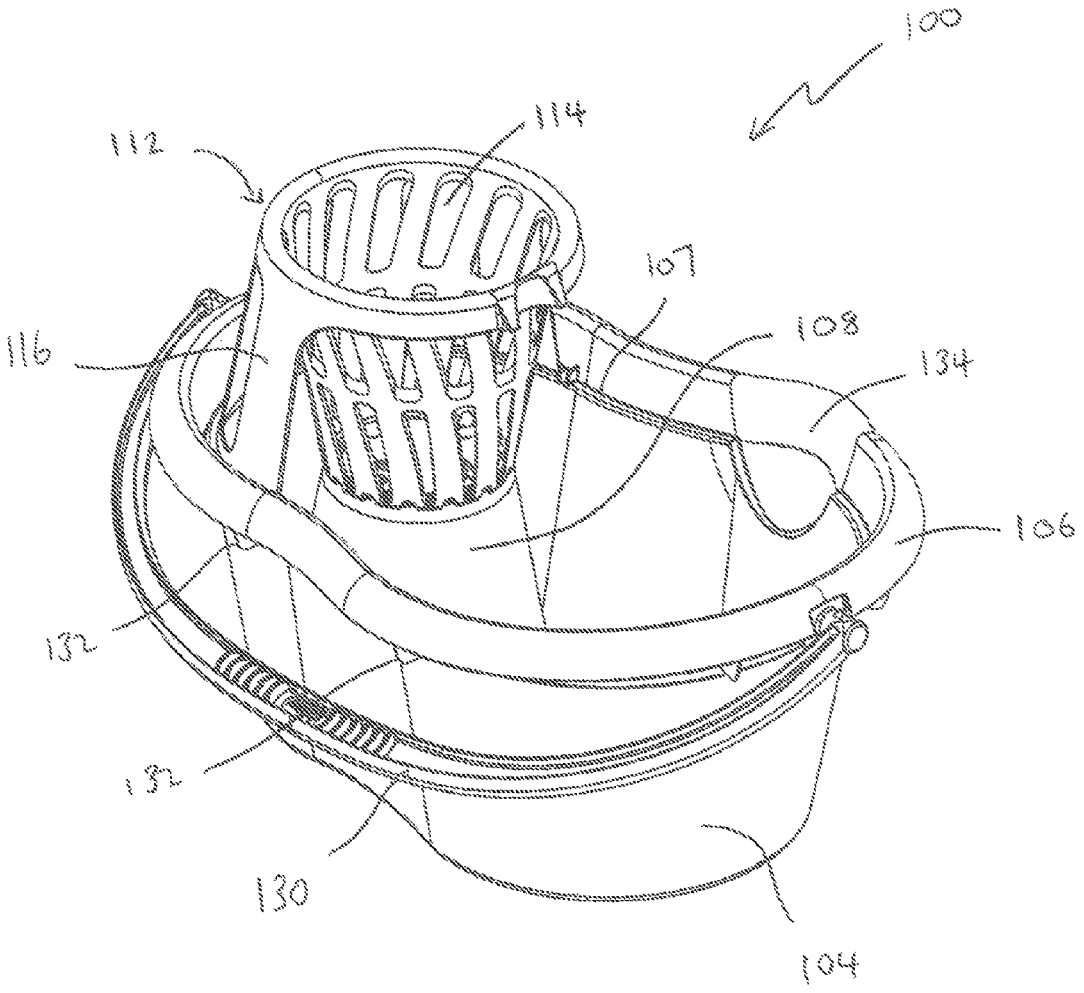
FIG. 1 is a perspective view of a bucket according to the invention.
Figure 2:
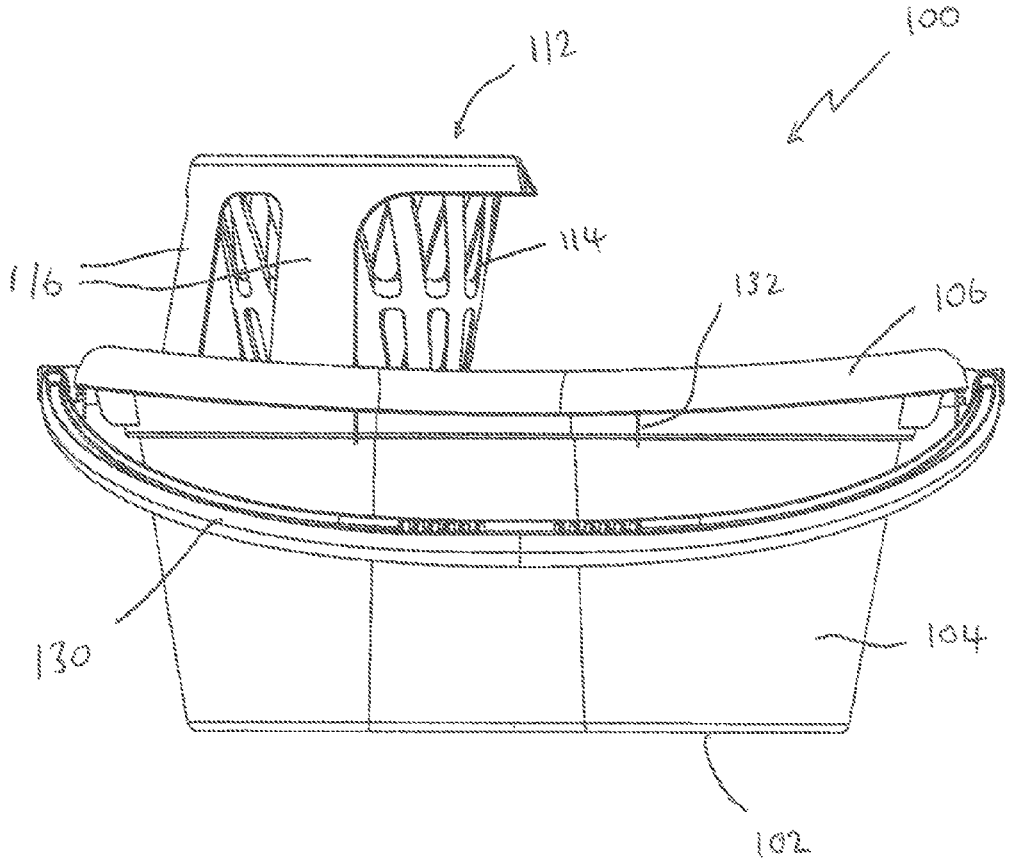
FIG. 2 is a side view of the bucket shown in FIG. 1.
Figure 3:
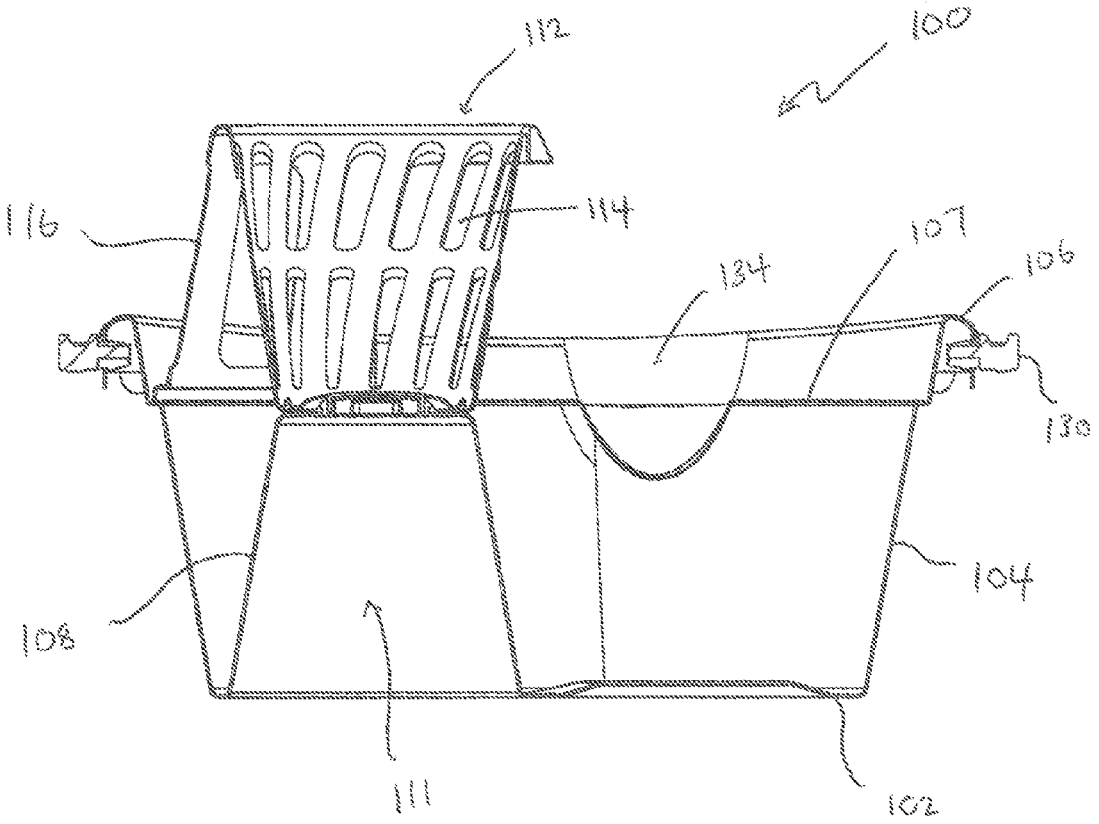
FIG. 3 is a cross section side view of the bucket shown in FIG. 1.
Figure 4:
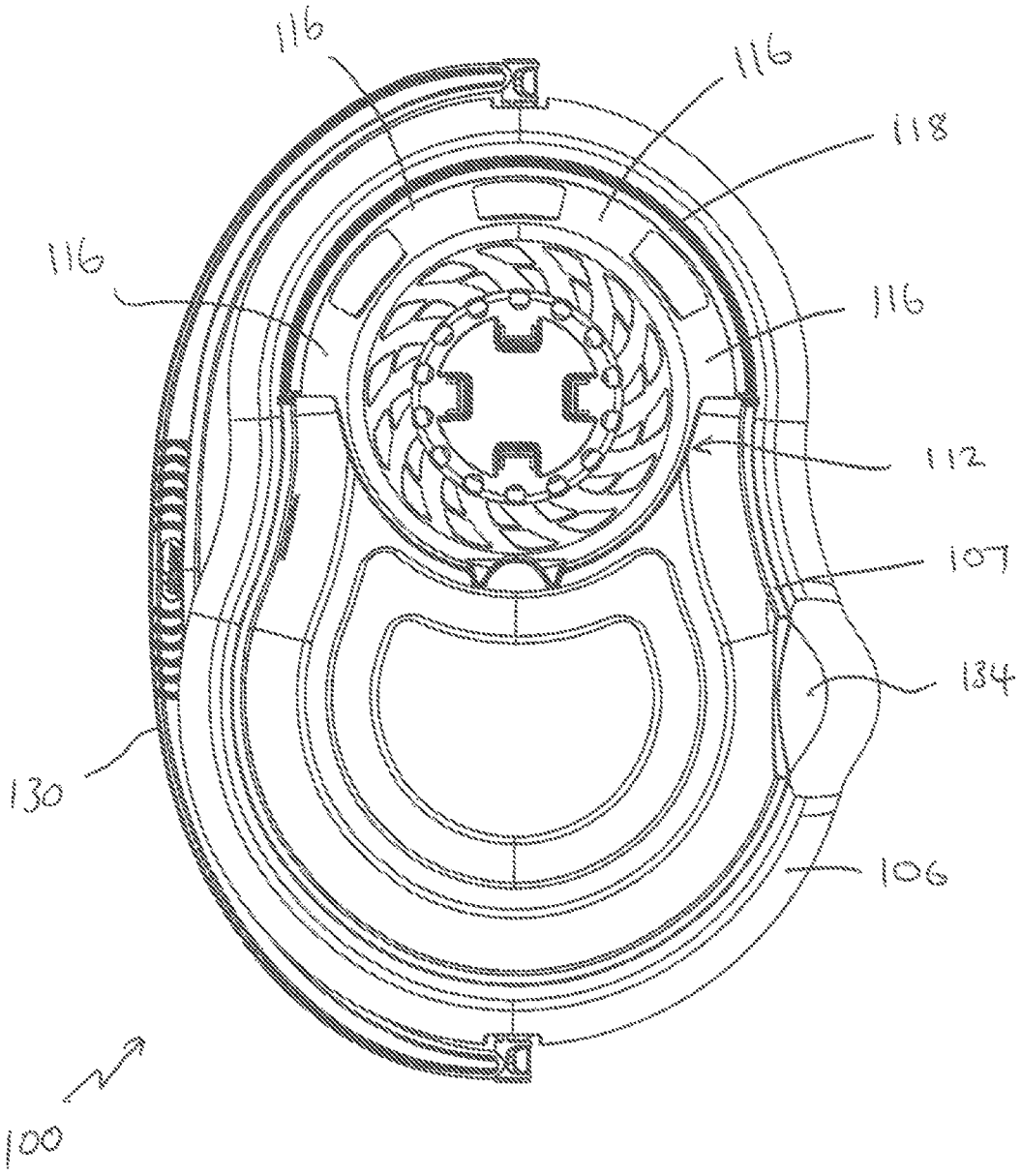
FIG. 4 is a plan view of the bucket shown in FIG. 1.
Figure 5:
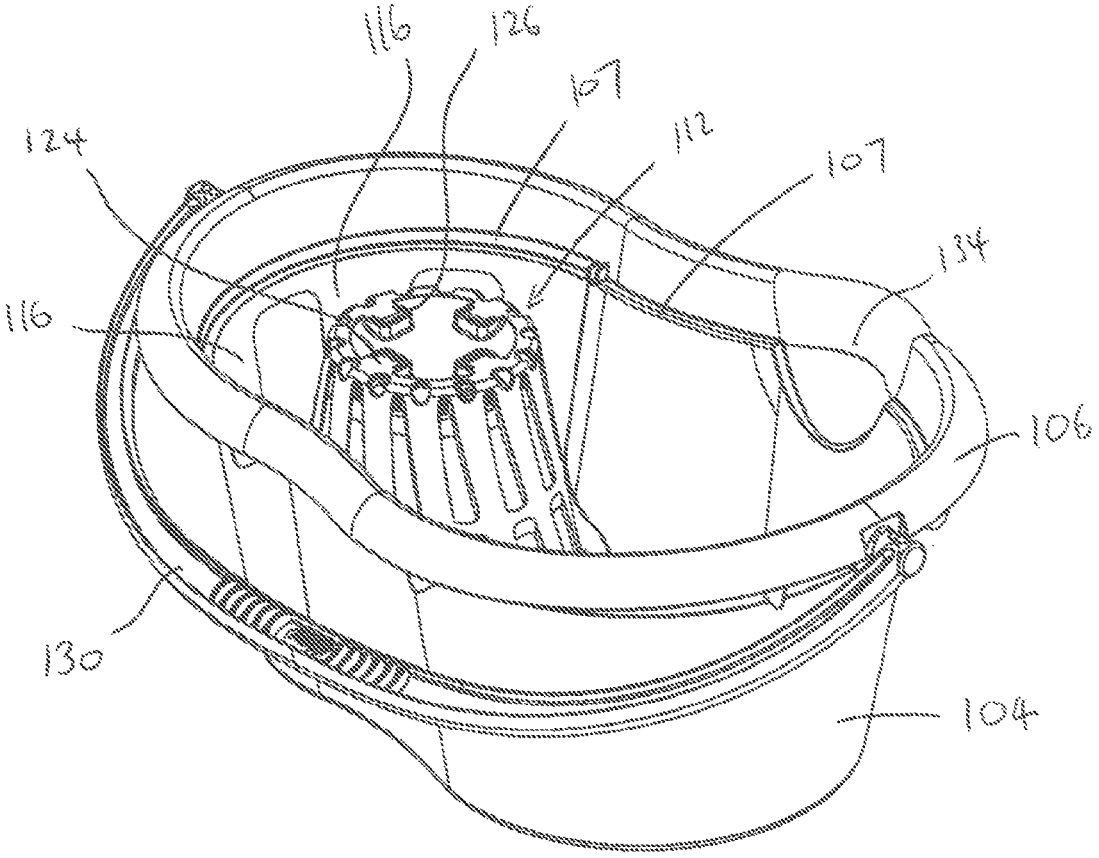
FIG. 5 is a perspective view of the bucket shown in FIG. 1 when the wringer attachment is in a stored state.
Figure 6:
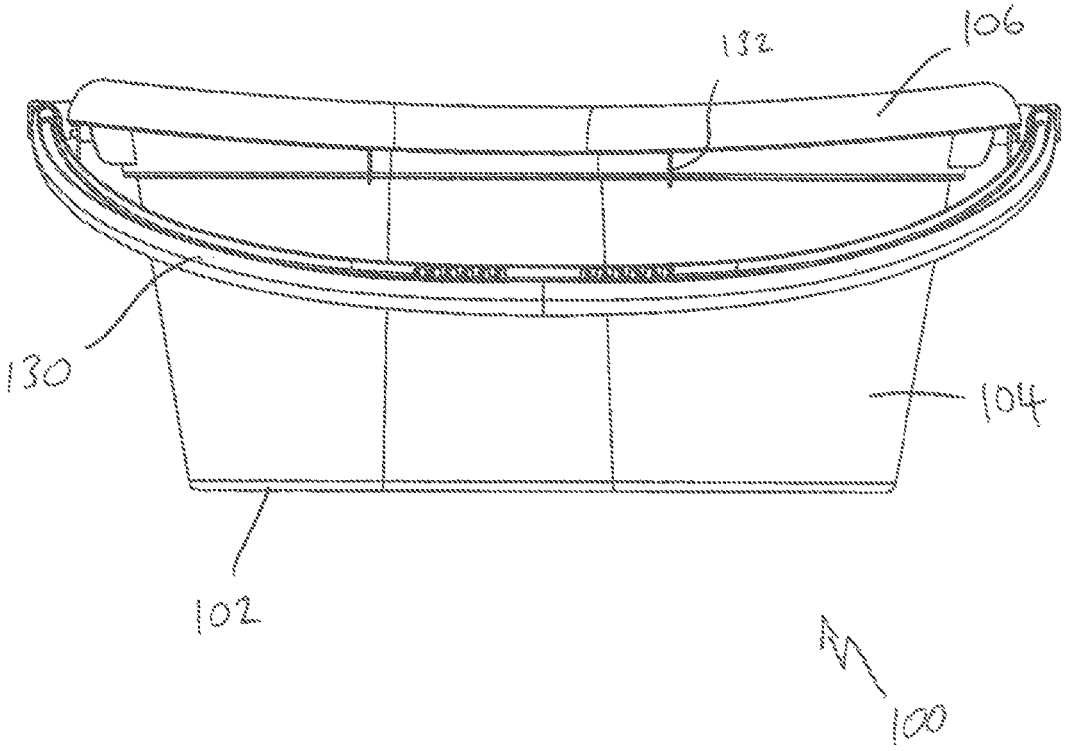
FIG. 6 is a side view of the bucket shown in FIG. 5.
Figure 10:
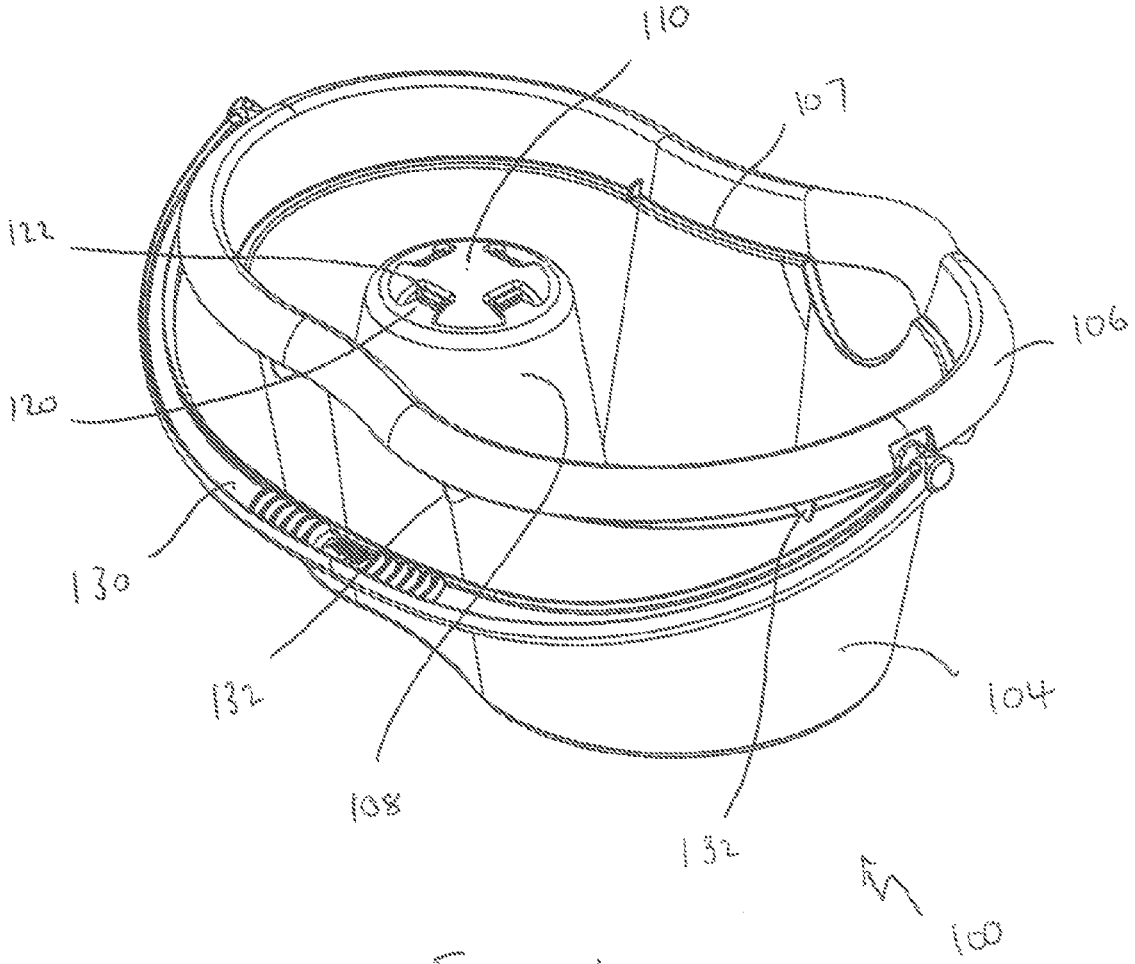
Figure 11:
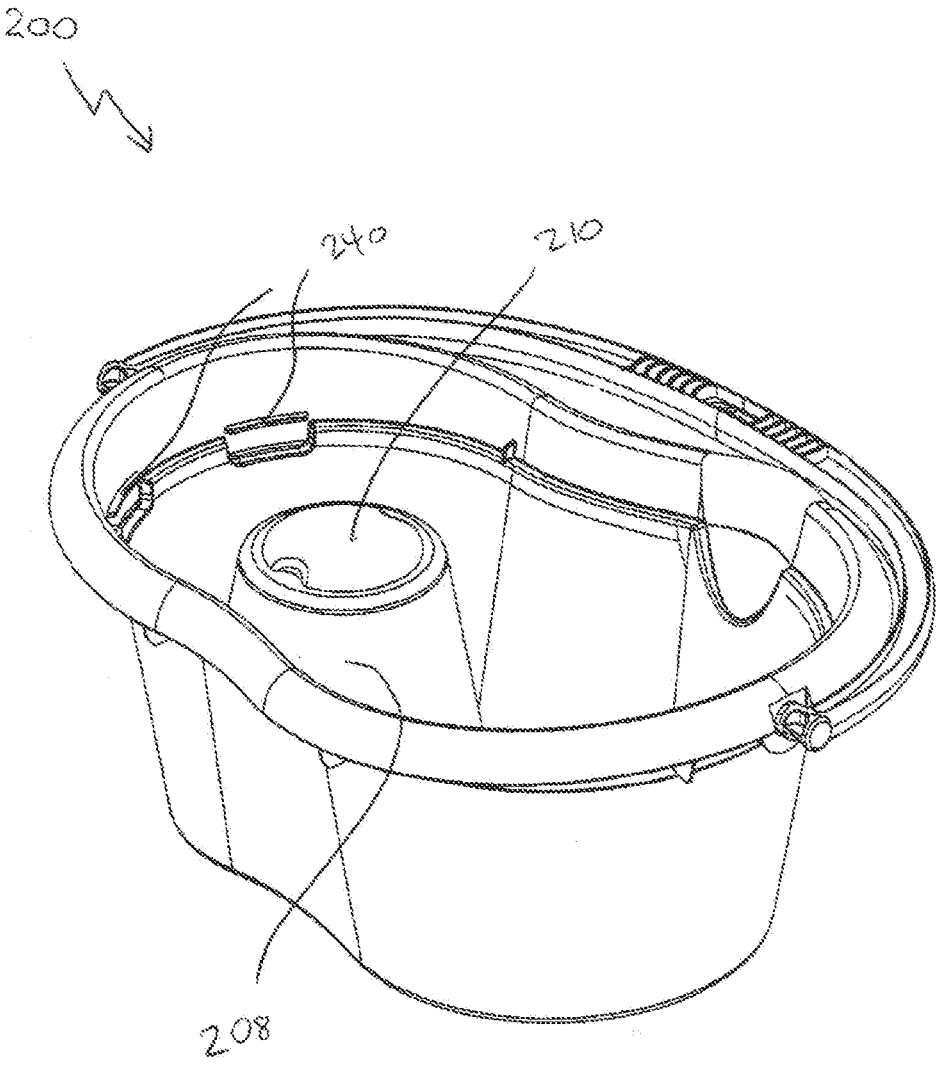

FIG. 10 is a perspective view of the bucket shown in FIG. 1 with the wringer attachment removed; and FIG. 11 is a perspective view of an alternative bucket according to the invention with the wringer removed. With reference to the drawings, there is shown a bucket 100 made from moulded plastics material comprising a base 102 and a continuous sidewall 104 that extends upwardly from the perimeter of the base 102 and terminates in a curved edge 106. The curved edge 106 forms the perimeter of the opening of the bucket 100 and the base 102 and sidewall 104 together define a space for containing liquids such as water for cleaning purposes. A small lip or step 107 extends from the inner face of the sidewall 104 a short distance down from the curved edge 106.

A part 108 of the base 104 extends upwardly into the bucket 100. The part 108 is substantially frustoconical in shape and has a dome or convex shaped platform 110 on its upper face for supporting a wringer attachment 112. The part 108 extends into the bucket a distance sufficient for the platform 110 to lie in a region of the mouth of the bucket below the curved edge 106. The position of the platform 110 relative to the rest of the base 104 is such that the part 108 may support the wringer attachment 112 so that it extends substantially out from the bucket 100. The support 108 is substantially hollow and has a cavity 111 which is accessible from outside the bucket 100. The shape of the cavity 111 is substantially the same as the shape of the support 108 and shares the same tapering of sides. Thus, the support 108 of one bucket 100 may be nested in the cavity 111 of the support 108 of a corresponding bucket 100.

Figure 9:
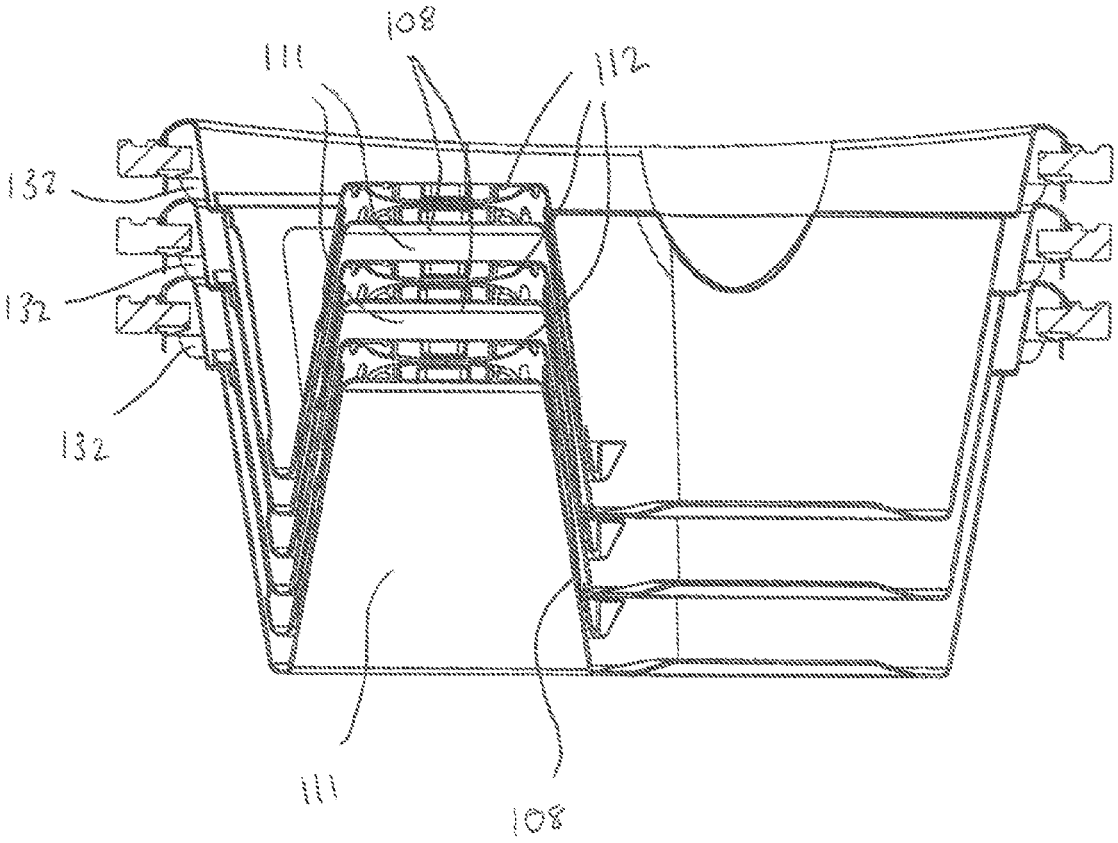
FIG. 9 is a cross section side view of a number of buckets shown in FIG. 5 when in a stacked arrangement.

The wringer attachment 112 is also made from moulded plastics material and is frustoconical in shape, similar to the shape of the wringer support 108. Part of the underside face of the closed end of the wringer 112 is substantially concave and shaped to conform to the dome shape of the platform 110. The wringer 112 is substantially hollow and has an opening through which may be passed the head of a mop comprising cleaning elements such as cloth strings or microfibre strips. The wringer attachment 112 comprises a plurality of apertures 114 that enable water and other liquids from a mop (not shown) to exit the wringer 112 when a wet mop head is urged into the wringer 112. The shape and dimensions of the wringer 112 and support 108 are chosen so that they conform to one another. Thus, when the wringer 112 is inverted, it may be seated and stacked on the wringer support 108. The wringer 112 can therefore be nested between the support 101 of one bucket 100 and the cavity 111 of the support 108 of an adjacent bucket 100 when two corresponding buckets are stacked together, as shown in FIG. 9. A plurality buckets 100 according to the present invention can therefore be stacked together in a smaller space than conventional mop buckets.

Figure 7:
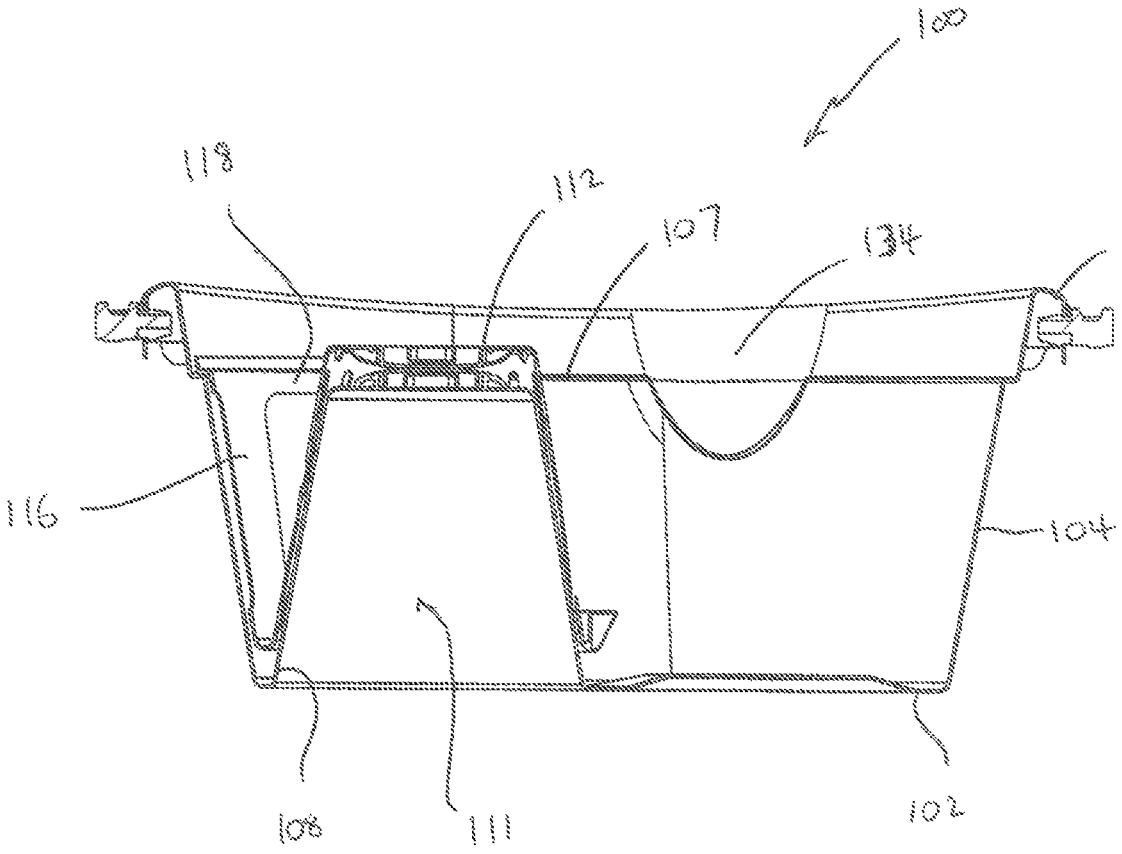
FIG. 7 is a cross section side view of the bucket shown in FIG. 5.
Figure 8:
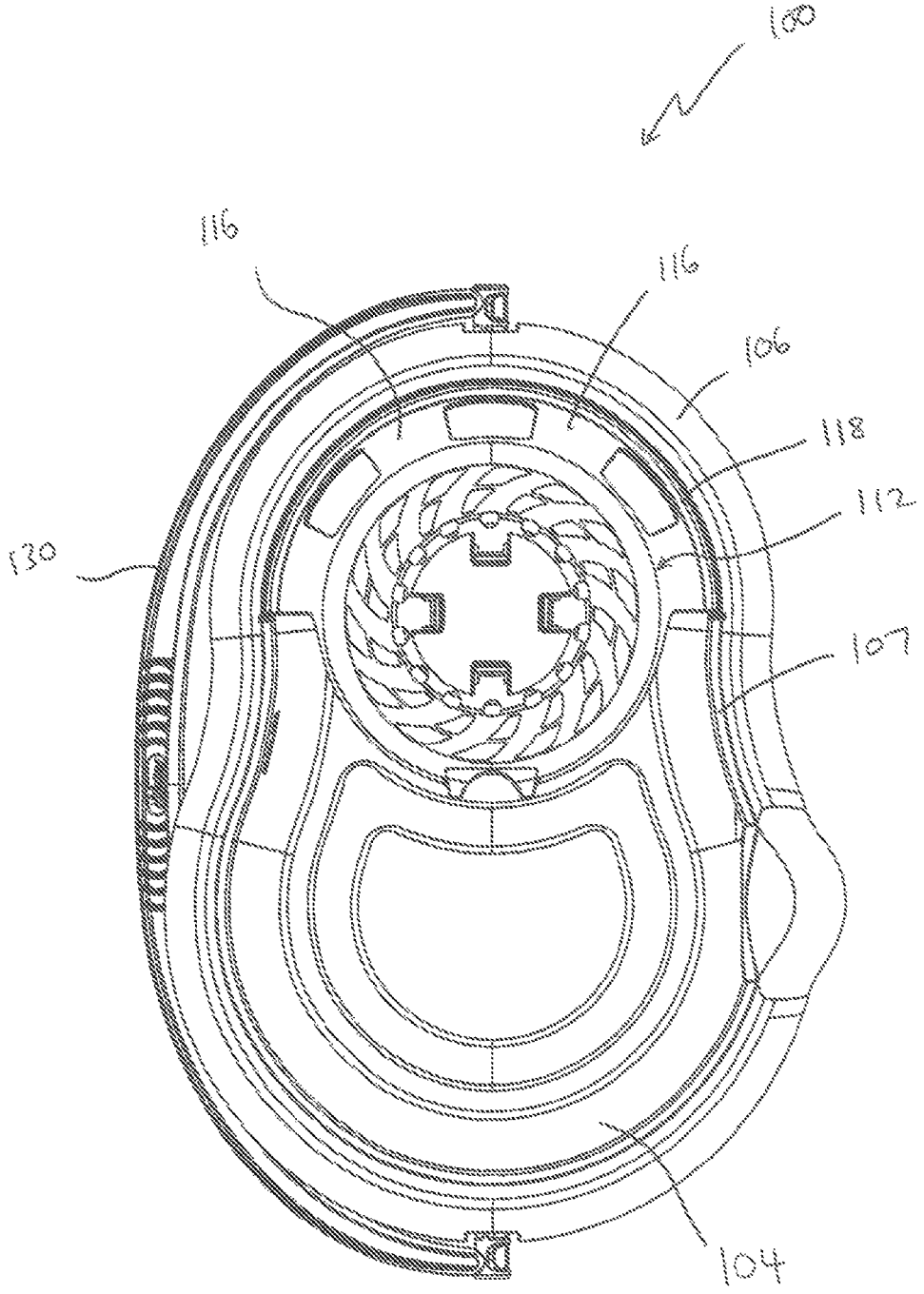
FIG. 8 is a plan view of the bucket shown in FIG. 5.

A plurality of arms 116 extend out from the top edge of the wringer 112. The arms 116 extend at an angle downwardly from the top edge and taper away from the body of the wringer 112. The tapering of the arms 110 is such that, when the wringer 112 is inverted and seated on the support 108, the arms 116 conform to and rest against the adjacent inner face of the sidewall 104 of the bucket 100. The ends of the arms 116 are joined together by a curved end piece 118 that also conforms to the inner face of the sidewall 104 and that helps to hold the arms 116 at spaced apart intervals around the wringer 112. The length of the arms 116 and position of the curved end piece 118 are such that, when the wringer 112 is arranged to sit on the support 108 and to extend upwardly from the bucket 100, the curved piece 118 rests against and is supported by the lip 107 of the bucket 100. The arms 116, curved piece 118 and lip 107 therefore interact to hold the wringer 112 in a stable position when the wringer 112 is attached to and supported from the platform 110 of the support 108. The arms 116 and lip 107 therefore help to prevent the wringer 112 from being disengaged from the support 108 when a mop head is urged into the wringer 112. The curved end piece 118 is also arranged to engage the lip 107 when the wringer is detached from the platform 110, inverted and stacked upon the support 108 as shown in FIG. 7.

The wringer 112 may be attached to the platform 110 of the support 108 by mutually engaging formations. In this embodiment, four recesses 120 are formed at equally spaced intervals around the circumference of the platform 110. Each recess 120 extends toward the centre of the platform 110 and the inner face of each recess 120 comprises a resilient projection 122. Four corresponding protrusions 124 are arranged at equally spaced intervals around the circumference of the concave portion of the wringer 112. The protrusions 124 are positioned such that, when the wringer 112 is seated on the platform 110, the protrusions 124 align with the recesses 120. The shape of the protrusions 124 is such that they conform, to the shape of the recesses 120. Each protrusion 124 has a lip 126 which is arranged to engage with the projections of the recesses 120 to hold the wringer 112 firmly in place.

The bucket 100 further comprises a handle 130 which is attached at two points to the curved edge 106 of the bucket 100. The handle 130 is attached such that the support 108 lies substantially between the two attachment points. Therefore, the centre of gravity of the bucket falls substantially beneath the handle 130 when the bucket 100 is supported from the handle 130.

A plurality of ribs 132 are formed on the outer face of the sidewall 104 beneath the curved edge 106 and are arranged to abut the curved edge of the adjacent bucket below 100 when in a stacked arrangement. The ribs 132 are provided so that, when two or more corresponding buckets 100 are stacked on top of one another, the buckets 100 are separated by a distance equivalent to the height of the ribs 132. A curved spout 134 is formed along part of the perimeter of the mouth of the bucket to enable liquid contained within the bucket 100 to be easily poured away.

In an alternative embodiment, the bucket 200 is substantially the same as the first embodiment in all respects apart from the way in which the wringer is attached to the support 208. In this embodiment, there are only two mutually cooperating formations on the platform 210 and wringer respectively that clip together. Further mutually cooperating formations 240 are provided on the inner face of the sidewall of the bucket 100 and the arms of the wringer respectively. The formations 240 serve to retain the arms and hold the wringer firmly in place when attached to and seated on the platform 210.

The above embodiments are described by way of example only. Many variations are possible without departing from the scope of the invention as defined in the appended claims.

The invention claimed is:

1. A mop bucket comprising:

a side;

a detachable wringer, wherein a part of the side extends into the bucket to define a wringer support which comprises a cavity which is accessible from the side, said wringer support being shaped to receive a corresponding support on a corresponding bucket, and wherein the detachable wringer is supportable by the wringer support in each of two orientations, in a first orientation the detachable wringer in use being supported by and extending upwards from the wringer support and in a second orientation the wringer being inverted to lie over and to surround said wringer support, said wringer support comprising inner and outer surfaces, the inner surface of a part of the wringer being shaped and dimensioned to conform to the shape of and surround at least a part of the support and said part of the wringer having an outer surface that is shaped and dimensioned to conform to the shape of the cavity whereby, in use, the wringer may be arranged between part of the support of one bucket and part of the support of another one of said bucket thereby to be in conformity with the shape of the bucket cavity and the support between which the wringer is positioned; and a lip that extends into the bucket from a side and the wringer comprises one or more supporting arms that are arranged such that, in use, an end of the or each arm contacts the lip whereby the wringer is supported by the lip.

2. A mop bucket as claimed in claim 1, wherein the side comprises the base and further comprising a sidewall.

3. A mop bucket as claimed in claim 1, further comprising a handle which is attached to two points of a side, the handle being arranged such that, when the bucket is supported via the handle, the center of gravity of the bucket is substantially between the two points.

4. A mop bucket according to claim 1, wherein the bucket has a vertical plane of symmetry when supported by the handle and a line between said two points at which the handle is secured to the side lies in said plane.

5. A mop bucket as claimed in claim 1, wherein part of the support and part of the wringer are substantially the same shape.

6. A plurality of the mop bucket of claim 1 arranged in a stack of the mop buckets, and detachable wringers, wherein, the mop buckets each comprise a base, with the wringer support extending into the mop bucket from the base and provides support for the detachable wringer when in a non-inverted position, each said wringer support additionally provides support for the detachable wringer when the wringer is in an inverted position to lie over and surround the wringer support, the stack comprising a plurality of buckets which alternate with a plurality of wringers wherein a wringer lies inverted over and surrounds the wringer support of one bucket and extends into the cavity of the wringer support of a second bucket, and one bucket of the stack is nested within another bucket of the stack.

7. A mop bucket comprising:

a side; and a detachable wringer, wherein a part of the side extends into the bucket to define a wringer support which comprises a cavity which is accessible from the side, said wringer support being shaped to receive a corresponding support on a corresponding bucket, and wherein the detachable wringer is supportable by the wringer support in each of two orientations, in a first orientation the detachable wringer in use being supported by and extending upwards from the wringer support and in a second orientation the wringer being inverted to lie over and to surround said wringer support, said wringer support comprising inner and outer surfaces, the inner surface of a part of the wringer being shaped and dimensioned to conform to the shape of and surround at least a part of the support and said part of the wringer having an outer surface that is shaped and dimensioned to conform to the shape of the cavity whereby, in use, the wringer may be arranged between part of the support of one bucket and part of the support of another one of said bucket thereby to be in conformity with the shape of the bucket cavity and the support between which the wringer is positioned, wherein the wringer and the support comprise mutually cooperating attachment means that enable the wringer to be attached to the support, and wherein the attachment means on the support are clips and the attachment means on the wringer are apertures for receiving the clips.

8. A mop bucket as claimed in claim 7, wherein the side comprises the base and further comprising a sidewall.

9. A mop bucket as claimed in claim 7, further comprising a handle which is attached to two points of a side, the handle being arranged such that, when the bucket is supported via the handle, the center of gravity of the bucket is substantially between the two points.

10. A mop bucket according to claim 7, wherein the bucket has a vertical plane of symmetry when supported by the handle and a line between said two points at which the handle is secured to the side lies in said plane.

11. A mop bucket as claimed in claim 7, wherein part of the support and part of the wringer are substantially the same shape.

12. A plurality of the mop bucket of claim 7, arranged in a stack of the mop buckets, and detachable wringers, wherein, the mop buckets each comprise a base, with the wringer support extending into the mop bucket from the base and provides support for the detachable wringer when in a non-inverted position, each said wringer support additionally provides support for the detachable wringer when the wringer is in an inverted position to lie over and surround the wringer support, the stack comprising a plurality of buckets which alternate with a plurality of wringers wherein a wringer lies inverted over and surrounds the wringer support of one bucket and extends into the cavity of the wringer support of a second bucket, and one bucket of the stack is nested within another bucket of the stack.

13. A mop bucket comprising:

a side; and a detachable wringer, wherein a part of the side extends into the bucket to define a wringer support which comprises a cavity which is accessible from the side, said wringer support being shaped to receive a corresponding support on a corresponding bucket, and wherein the detachable wringer is supportable by the wringer support in each of two orientations, in a first orientation the detachable wringer in use being supported by and extending upwards from the wringer support and in a second orientation the wringer being inverted to lie over and to surround said wringer support, said wringer support comprising inner and outer surfaces, the inner surface of a part of the wringer being shaped and dimensioned to conform to the shape of and surround at least a part of the support and said part of the wringer having an outer surface that is shaped and dimensioned to conform to the shape of the cavity whereby, in use, the wringer may be arranged between part of the support of one bucket and part of the support of another one of said bucket thereby to be in conformity with the shape of the bucket cavity and the support between which the wringer is positioned, wherein the support extends into the bucket to a position at which the wringer may be supported such that the wringer extends substantially out of the bucket.

14. A mop bucket as claimed in claim 13, wherein the side comprises the base and further comprising a sidewall.

15. A mop bucket as claimed in claim 13, further comprising a handle which is attached to two points of a side, the handle being arranged such that, when the bucket is supported via the handle, the center of gravity of the bucket is substantially between the two points.

16. A mop bucket according to claim 13, wherein the bucket has a vertical plane of symmetry when supported by the handle and a line between said two points at which the handle is secured to the side lies in said plane.

17. A mop bucket as claimed in claim 13, wherein part of the support and part of the wringer are substantially the same shape.

18. A plurality of the mop bucket of claim 13, arranged in a stack of the mop buckets, and detachable wringers, wherein, the mop buckets each comprise a base, with the wringer support extending into the mop bucket from the base and provides support for the detachable wringer when in a non-inverted position, each said wringer support additionally provides support for the detachable wringer when the wringer is in an inverted position to lie over and surround the wringer support, the stack comprising a plurality of buckets which alternate with a plurality of wringers wherein a wringer lies inverted over and surrounds the wringer support of one bucket and extends into the cavity of the wringer support of a second bucket, and one bucket of the stack is nested within another bucket of the stack.

19. A mop bucket comprising:

a side; and a detachable wringer, wherein a part of the side extends into the bucket to define a wringer support which comprises a cavity which is accessible from the side, said wringer support being shaped to receive a corresponding support on a corresponding bucket, and wherein the detachable wringer is supportable by the wringer support in each of two orientations, in a first orientation the detachable wringer in use being supported by and extending upwards from the wringer support and in a second orientation the wringer being inverted to lie over and to surround said wringer support, said wringer support comprising inner and outer surfaces, the inner surface of a part of the wringer being shaped and dimensioned to conform to the shape of and surround at least a part of the support and said part of the wringer having an outer surface that is shaped and dimensioned to conform to the shape of the cavity whereby, in use, the wringer may be arranged between part of the support of one bucket and part of the support of another one of said bucket thereby to be in conformity with the shape of the bucket cavity and the support between which the wringer is positioned, wherein the wringer and the support comprise mutually cooperating attachment means that enable the wringer to be attached to the support, and wherein, in use, the attachment means inhibits rotation of the wringer relative to the side when a mop head is rotated within the wringer.

20. A mop bucket comprising:

a side;

a detachable wringer, wherein a part of the side extends into the bucket to define a wringer support which comprises a cavity which is accessible from the side, said wringer support being shaped to receive a corresponding support on a corresponding bucket, and wherein the detachable wringer is supportable by the wringer support in each of two orientations, in a first orientation the detachable wringer in use being supported by and extending upwards from the wringer support and in a second orientation the wringer being inverted to lie over and to surround said wringer support, said wringer support comprising inner and outer surfaces, the inner surface of a part of the wringer being shaped and dimensioned to conform to the shape of and surround at least a part of the support and said part of the wringer having an outer surface that is shaped and dimensioned to conform to the shape of the cavity whereby, in use, the wringer may be arranged between part of the support of one bucket and part of the support of another one of said bucket thereby to be in conformity with the shape of the bucket cavity and the support between which the wringer is positioned; and one or more ribs formed on the outside of a side and arranged to abut part of an adjacent bucket when two or more buckets are stacked together.

* * * * *